US009668589B2

(12) United States Patent
Cortez

(10) Patent No.: US 9,668,589 B2
(45) Date of Patent: Jun. 6, 2017

(54) PORTABLE CHANGING TABLE

(71) Applicant: Nicole M. Cortez, Port Hueneme, CA (US)

(72) Inventor: Nicole M. Cortez, Port Hueneme, CA (US)

( * ) Notice: Subject to any disclaimer, the term of this patent is extended or adjusted under 35 U.S.C. 154(b) by 0 days.

(21) Appl. No.: 14/543,308

(22) Filed: Nov. 17, 2014

(65) Prior Publication Data

US 2015/0135443 A1 May 21, 2015

Related U.S. Application Data

(60) Provisional application No. 61/905,187, filed on Nov. 16, 2013.

(51) Int. Cl.
*A47D 5/00* (2006.01)
*A47D 15/00* (2006.01)

(52) U.S. Cl.
CPC ..... *A47D 5/00* (2013.01); *A47D 5/006* (2013.01); *A47D 15/00* (2013.01); *A47D 15/003* (2013.01)

(58) Field of Classification Search
CPC . A47D 5/00; A47D 5/006; A47D 9/00; A47D 9/005; A47D 13/00; A47D 13/08; A47D 13/083; A47D 15/00; A47D 15/001; A47D 15/003; A47G 9/06; A47G 9/062; A47C 31/10; A47C 31/11; A47C 31/113; A47C 31/116; A47C 7/62; A47C 7/66
USPC ..... 5/655, 652, 657, 420, 417; 297/184.13, 297/184.1, 219.1, 219.12
See application file for complete search history.

(56) References Cited

U.S. PATENT DOCUMENTS 3,659,297 A * 5/1972 Schutz ..... A47D 15/008 108/90
4,123,809 A * 11/1978 Pugh ..... A47K 3/034 4/551
4,712,258 A * 12/1987 Eves ..... A47D 5/006 5/420
4,935,973 A * 6/1990 Behrman ..... A47D 5/00 5/2.1
4,946,221 A * 8/1990 Livingston ..... A47D 15/00 297/184.13
5,299,336 A * 4/1994 Marteeny ..... A47D 5/006 4/659
5,309,586 A * 5/1994 Sies ..... A47D 9/02 297/184.13
5,437,061 A * 8/1995 Kenner ..... A41D 3/08 2/69

(Continued)

*Primary Examiner* — Robert G Santos
(74) *Attorney, Agent, or Firm* — Jarod R. Marrott; Kirton McConkie, PC

(57) ABSTRACT

A portable changing table is disclosed. The portable changing table comprises a flexible support material and a support pocket disposed within the flexible support material. A rigid planar material is disposed within the support pocket and rigidly supports the flexible support material. An extension extends from the flexible support material and forms a securing envelope configured to attach to a child safety seat or a child stroller. Securing straps attach to the flexible support material and are configured to attach the flexible support material to a child safety seat or a child stroller. The securing straps and securing envelope provide tension across the flexible support material to provide a rigidly supported substantially horizontal surface where a caregiver can change a diaper or clothes of the infant or small child.

17 Claims, 7 Drawing Sheets

(56) References Cited

U.S. PATENT DOCUMENTS 5,730,490 A * 3/1998 Mortenson ..... A47D 13/02 297/184.11
5,956,767 A * 9/1999 Imm ..... A41B 13/06 2/69
6,012,184 A * 1/2000 Childers ..... A47D 15/00 5/416
6,019,421 A * 2/2000 Roh ..... A47C 29/006 297/184.13
6,039,393 A * 3/2000 Roh ..... A47C 29/006 297/184.13
6,056,355 A * 5/2000 Klassen ..... A47D 15/00 297/184.1
6,209,953 B1 * 4/2001 Mackay ..... B60N 2/28 297/184.1
6,298,509 B1 * 10/2001 Vickers ..... A47D 5/006 5/655
6,327,726 B1 * 12/2001 Weber ..... A47D 5/006 297/219.1
6,389,624 B1 * 5/2002 Madole ..... A47D 5/006 5/424
6,481,791 B1 * 11/2002 Facchini ..... A47D 13/02 297/184.1
6,694,552 B1 * 2/2004 Vickers ..... A47D 5/006 5/655
6,702,374 B2 * 3/2004 Kams ..... A47D 13/02 135/93
7,065,814 B2 * 6/2006 Rutkowski ..... A47D 5/006 128/876
7,083,228 B1 * 8/2006 Al Sawan ..... B62B 9/142 297/184.13
7,284,790 B1 * 10/2007 Brewer ..... A47C 7/66 297/184.13
7,404,219 B2 * 7/2008 Berkey ..... A47C 21/046 5/655
7,530,635 B2 * 5/2009 Schramek-Flye ..... A47D 1/103 297/17
8,118,364 B2 * 2/2012 Davis ..... A47D 15/006 128/869
8,151,389 B1 * 4/2012 Lando ..... A47D 5/006 5/655
8,245,338 B1 * 8/2012 Nemeth ..... A47D 5/003 5/417
8,316,490 B1 * 11/2012 Bilak ..... A47D 5/006 5/655
8,341,783 B2 * 1/2013 Beck ..... A47D 15/003 5/417
9,095,225 B2 * 8/2015 Behrman ..... A47D 15/00
2004/0026965 A1 * 2/2004 Haney ..... B60N 2/6009 297/184.13
2005/0050638 A1 * 3/2005 Rutkowski ..... A47D 5/006 5/655
2007/0289060 A1 * 12/2007 Berkey ..... A47C 21/046 5/99.1
2008/0290707 A1 * 11/2008 Schramek-Flye ..... A47D 1/103 297/255
2010/0072793 A1 * 3/2010 Kress ..... A47C 7/66 297/184.13
2010/0170039 A1 * 7/2010 Davis ..... A47D 15/006 5/494
2012/0030877 A1 * 2/2012 Beck ..... A47D 15/003 5/655
2013/0057032 A1 * 3/2013 Turnage ..... A47D 15/00 297/184.13
2015/0089745 A1 * 4/2015 Behrman ..... A47D 5/00 5/655
2015/0135443 A1 * 5/2015 Cortez ..... A47D 5/00 5/655

* cited by examiner

PORTABLE CHANGING TABLE

CROSS-REFERENCE TO RELATED APPLICATIONS

This application claims the benefit of U.S. Provisional Patent Application Ser. No. 61/905,187 filed Nov. 16, 2013, entitled "Portable Changing Table for Car Seats and Strollers." The disclosure of the application to which the present application claims priority is incorporated by reference.

TECHNICAL FIELD

The present disclosure relates to portable apparatus and devices for changing an infant's clothes or diaper. More specifically, the present disclosure relates to portable apparatus and devices configured to convert a child safety seat or a child stroller into a diaper changing table for infants.

BACKGROUND

There are many types of changing tables configured to allow a caregiver to change diapers or clothes of an infant or a small child. Households with infants or small children often have dedicated furniture configured as changing tables. Changing tables are increasingly prevalent in public areas and allow caregivers to change an infant's or a small child's diapers or clothes while the caregivers and children are away from home. Many of these changing tables are configured as part of a tabletop or a countertop while others are mounted to walls. The wall-mounted changing tables are often configured to fold up to conserve space when the changing table is not in use. Consequently, other products have also been developed to protect an infant or small child from direct contact with a surface of the public changing table. Such products include portable diaper changing pads that provide a layer of protection between the child and the surface of the public changing table. Portable diaper changing pads are flexible, can be used on the rigid surface of the public changing table to protect the child from contact, and can be folded for easy transport. Unfortunately, on its own, the portable diaper changing pad does not provide the rigidity or support needed to change the diaper or clothes of an infant or small child. Equally unfortunate, the public changing table is not portable and a caregiver must seek out a public changing table when it is necessary to change a diaper. Therefore, there is an ongoing demand for a portable device to allow a caregiver to change an infant's or small child's diaper without needing to seek out a public changing table or without needing to find a flat, rigid surface. Such methods and systems are disclosed herein.

BRIEF SUMMARY

In some embodiments, the present application discloses a portable changing table that can comprise a flexible support material configured to support an infant or a small child, a support pocket disposed within the flexible support material, a rigid planar material disposed within the support pocket, the rigid planar material configured to rigidly support the flexible support material to support the infant or the small child, an extension extending from the flexible support material and forming a securing envelope, the securing envelope configured to selectably attach to a child safety seat or a child stroller, and securing straps attached to the flexible support material and configured to attach the flexible support material to a child safety seat or a child stroller, wherein the securing straps and securing envelope provide a tension across the flexible support material thereby providing a rigidly supported substantially horizontal surface where a caregiver can change a diaper or clothes of the infant or small child.

In other embodiments, the securing straps can comprise a pair of upper securing straps and a lower securing strap, the pair of upper securing straps attached to an end opposite the securing envelope, the lower securing strap attached to the extension. In yet other embodiments, the upper securing straps can be configured to secure the flexible support material to a stroller handle or a lower portion of a child safety seat. In some embodiments, the securing envelope can be configured to secure the flexible support material to a handle of the child safety seat or to a safety bar or a tray of the child stroller. In other embodiments, the lower securing strap can be configured to secure the flexible support material to the handle of child safety seat or to the safety bar or the tray of the child stroller. In yet other embodiments, the portable changing table can be configured to be secured to a child safety seat, to a child safety seat attached to a child stroller, and to a child stroller.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present disclosure relates to portable apparatus and devices for changing an infant's clothes or diaper. More specifically, the present disclosure relates to portable apparatus and devices configured to convert a child safety seat or a child stroller into a diaper changing table for infants or small children.

Figure 1:
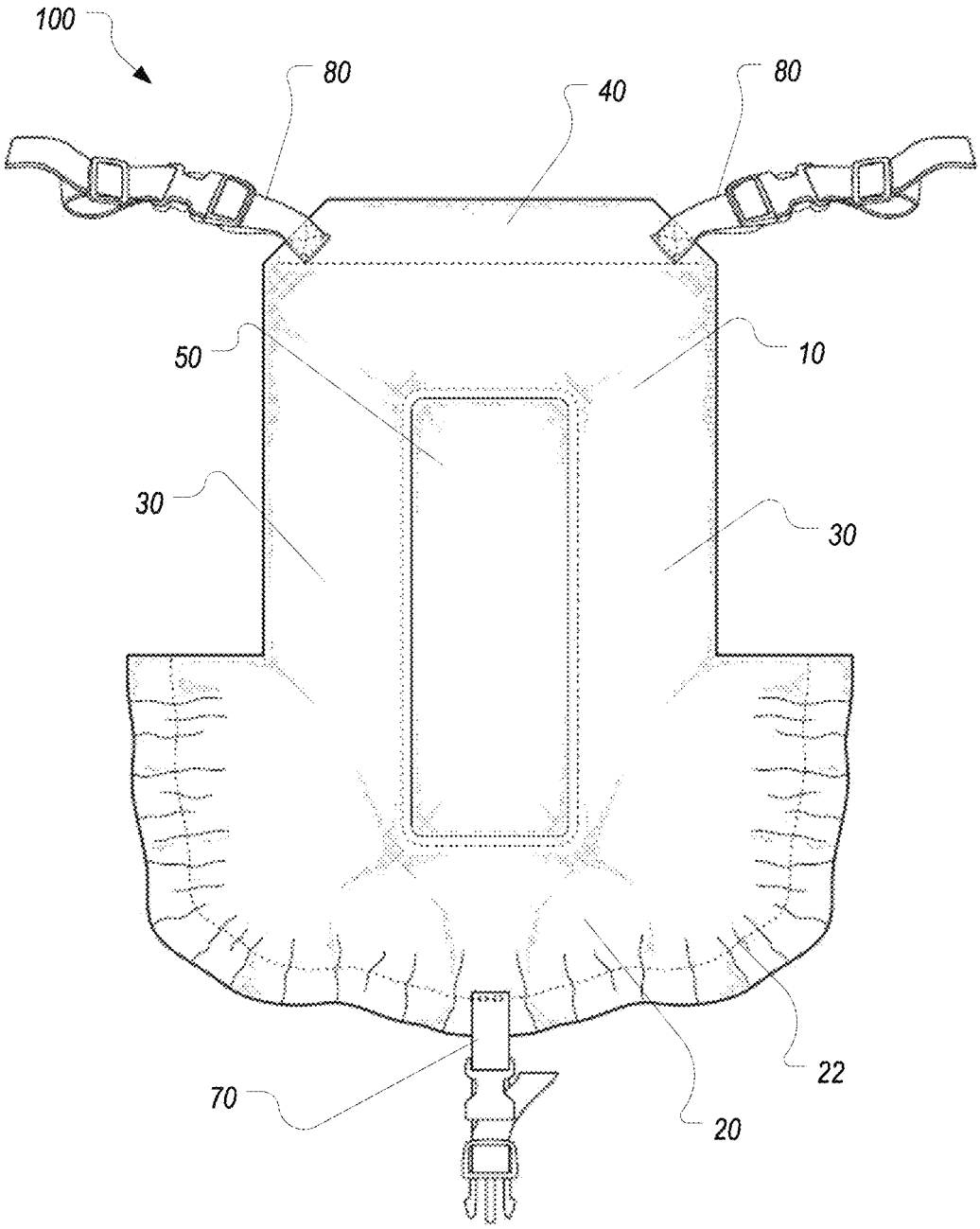
FIG. 1 illustrates a top view of some embodiments of a portable device configured to convert a child safety seat or a child stroller into a diaper changing table for infants or small children.

FIG. 1 illustrates some embodiments of a portable device 100 configured to convert a child safety seat or a child stroller into a diaper changing table for infants. FIG. 1 shows a top view of the portable device 100. In some embodiments, the portable device can comprise a flexible support material 10. The flexible support material 10 can be configured as a substantially rectangular layer of material. In some embodiments, the flexible support material 10 can comprise a cloth fabric. In other embodiments, the flexible support material 10 can comprise layers of flexible material. In yet other embodiments, the flexible support material 10 can comprise cloth fabric, synthetic fabric, canvas, leather, faux leather, Naugahyde, nylon, rip-stop fabric or other similar materials. In some embodiments, the flexible support material 10 can comprise an extension 20 that extends from a lower portion of the flexible support material. In other embodiments, the flexible support material 10 comprises side portions 30 and an upper portion 40. In yet other embodiments, the extension 20 can extend to a width greater than that of the side portions 30. In some embodiments, an outer perimeter of the extension 20 can be rounded in shape.

In some embodiments, the extension 20 can comprise an elastic material 22 that is affixed or embedded into an outer perimeter of the extension such that the extension 20 can form a securing envelope 24. In other embodiments, the elastic material can comprise a natural rubber, a synthetic rubber, an elastomer, or other suitable materials. In yet other embodiments, the extension 20 can comprise an elastic synthetic fabric such as Spandex or elastane. In some embodiments, a drawstring or similar mechanism can replace the elastic material. In other embodiments, the drawstring can comprise an elastic cord. In yet other embodiments, the securing envelope 24 can be formed by folding an outer perimeter of the extension 20 and sewing or securing loose ends to form a securing envelope 24. In some embodiments, the securing envelope 24 can be formed by an adjustable strap and buckle, hook and loop fasteners, snaps, buttons, clasp, couplers, tie strap, or any other suitable material. In other embodiments, the securing envelope 24 can be replaced with one or more securing straps. In some embodiments, the flexible support material 10 can comprise a support pocket 50. The support pocket 50 can be disposed in the center of the flexible support material 10 and can be formed in a rectangular shape with the longest dimension of the support pocket 50 running parallel with the longest dimension of the flexible support material 10. The support pocket 50 can be configured to receive a planar rigid material 60. The planar rigid material 60 can be configured to give rigidity to the flexible support material 10. In some embodiments the planar rigid material 60 can comprise a sheet of rigid plastic. In other embodiments, the planar rigid material 60 can comprise wooden shelving board, high density foam, water resistant foam, plastic, high density fabric, metal sheeting, inflatable air pockets, permanently inflated air pockets, firm padding, or other suitable materials. In yet other embodiments, the planar rigid material can be sewn into or permanently affixed to the support pocket 50. In some embodiments, the support pocket 50 can be configured to allow for placement and removal of the planar rigid material 60. In other embodiments, the support pocket 50 can be configured to allow for placement and removal of the planar rigid material 60 to allow for cleaning or washing of the portable device 100.

In some embodiments, the portable device 100 can comprise a lower securing strap 70. In other embodiments, the lower securing strap 70 can be attached to the extension 20. In yet other embodiments, the lower securing strap 70 can be configured to secure the portable device 100 to a child safety seat 200. The lower securing strap 70 can be configured to secure the portable device 100 to a handle 210 of a child safety seat 200. In some embodiments, the lower securing strap 70 can be configured to secure the portable device 100 to a child stroller 300. In other embodiments, the lower securing strap 70 can comprise nylon straps. In yet other embodiments, the lower securing strap 70 can comprise fabric strips, rope, cord, webbing, or other suitable materials. In some embodiments, the lower securing strap 70 can comprise tie-down hardware, connectors, fasteners, buckles, hook and loop fasteners, or any other suitable components for securing the lower securing strap 70 to the child safety seat 200 or child stroller 300. In other embodiments, the portable device 100 comprises a plurality of lower securing straps 70.

In some embodiments, the portable device 100 can comprise a pair of upper securing straps 80. In other embodiments, the portable device 100 can comprise a single upper securing strap 80. In yet other embodiments, the portable device 100 can comprise a plurality of upper securing straps 80. In other embodiments, the upper securing strap 80 can be attached to the upper portion 40. In yet other embodiments, the upper securing straps 80 can be configured to secure the portable device 100 to a child safety seat 200. The upper securing straps 80 can be configured to secure the portable device 100 to a lower portion of a child safety seat 200. In some embodiments, the upper securing straps 80 can be configured to secure the portable device 100 to a child stroller 300. The upper securing straps 80 can be configured to secure the portable device 100 to a handle of the child stroller 300. In other embodiments, the upper securing straps 80 can comprise nylon straps. In yet other embodiments, the upper securing straps 80 can comprise fabric strips, rope, cord, webbing, or other suitable materials. In some embodiments, the upper securing straps 80 can comprise tie-down hardware, connectors, fasteners, buckles, hook and loop fasteners, or any other suitable components for securing the upper securing straps 80 to the child safety seat 200 or child stroller 300.

In some embodiments, the portable device 100 can comprise a stowing buckle 90. In other embodiments, the stowing buckle 90 can be attached to the reverse of the flexible support material 10. In yet other embodiments, the stowing buckle 90 can be configured to secure the portable device 100 in a folded configuration. In some embodiments, the stowing buckle 90 can be configured to selectably couple with the lower securing strap 70 to secure the portable device 100 in a folded or stowed configuration. In yet other embodiments, the stowing buckle 90 can comprise fabric strips, rope, cord, webbing, or other suitable materials. In some embodiments, the stowing buckle 90 can comprise tie-down hardware, connectors, fasteners, buckles, hook and loop fasteners, or any other suitable components for securing the stowing buckle 90 to the lower securing strap 70.

Figure 2:
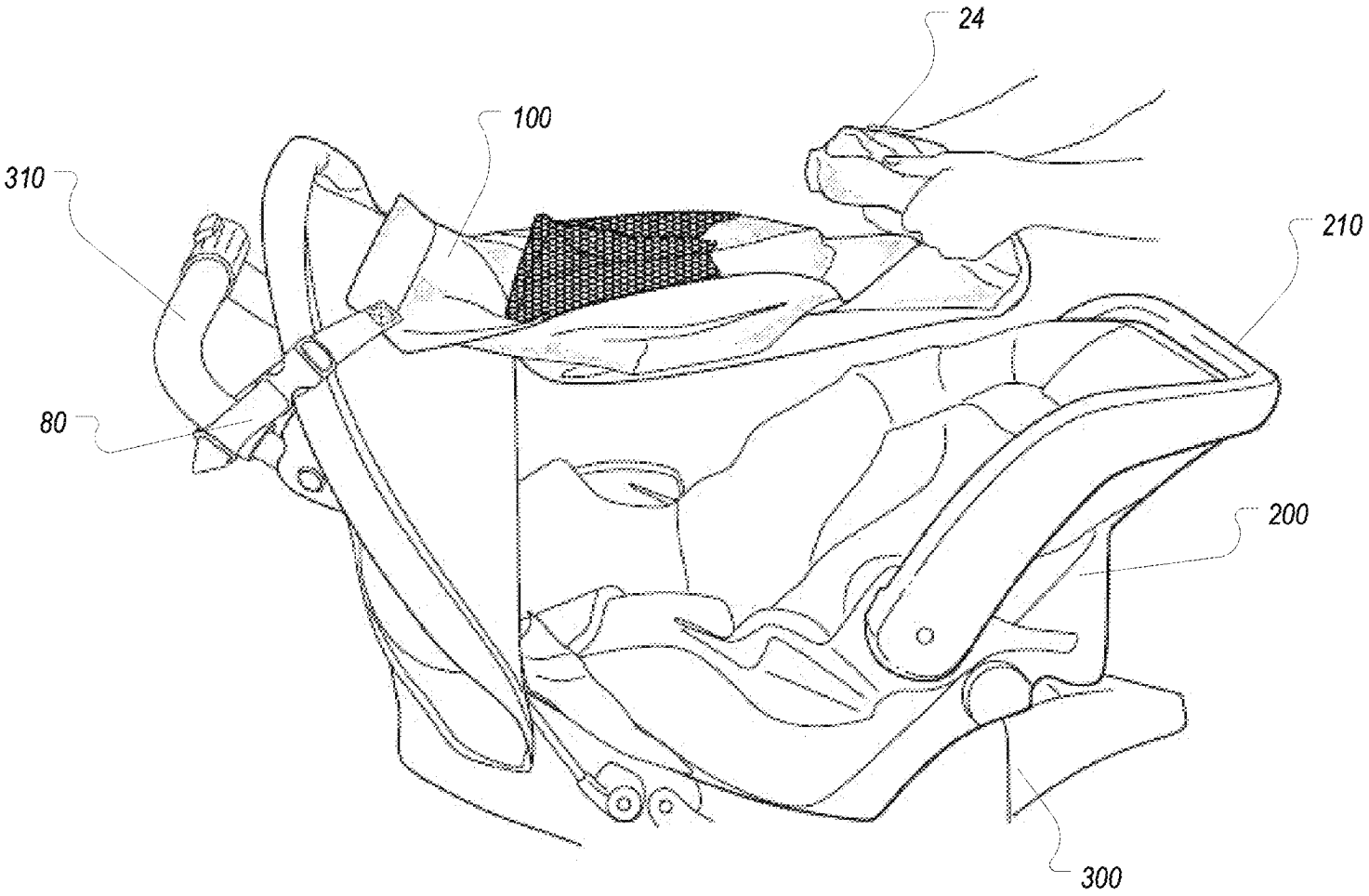
FIG. 2 illustrates a side perspective view of some embodiments of a portable device configured to convert a child safety seat or a child stroller into a diaper changing table for infants or small children.

FIG. 2 illustrates some embodiments of the portable device 100 being selectably coupled to a child safety seat 200 that is attached to a child stroller 300. In other embodiments, the portable device 100 can be selectably coupled to a child safety seat 200 that is attached to a child stroller 300 by attaching the upper securing straps 80 to a handle 310 of the child stroller. The portable device 100 can be selectably coupled to the handle 210 of the child safety seat 200 by extending the securing envelope 24 over the handle 210 of the child safety seat 200. In some embodiments, the elastic material 22 of the securing envelope can supply tension that secures the extension 20 to the handle 210 of the child safety seat 200. In other embodiments, the lower securing strap 70 can also be secured to the handle 210 of the child safety seat 200. In yet other embodiments, the upper securing straps 80, the securing envelop 24, and/or the lower securing strap 70 can be adjusted such that sufficient tension is supplied to maintain the portable device 100 in a substantially planar configuration. In some embodiments, the planar rigid material 60 can also maintain the portable device 100 in a substantially planar configuration.

In some embodiments, the portable device 100 can be selectably coupled to a child safety seat 200 that is not attached to a child stroller 300. In other embodiments, the portable device 100 can be selectably coupled to a child safety seat 200 by attaching the upper securing straps 80 to a portion of the child safety seat 200. The portable device 100 can be selectably coupled to the handle 210 of the child safety seat 200 by extending the securing envelope 24 over the handle 210 of the child safety seat 200. In some embodiments, the elastic material 22 of the securing envelope can supply tension that secures the extension 20 to the handle 210 of the child safety seat 200. In other embodiments, the lower securing strap 70 can also be secured to the handle 210 of the child safety seat 200. In yet other embodiments, the upper securing straps 80, the securing envelop 24, and/or the lower securing strap 70 can be adjusted such that sufficient tension is supplied to maintain the portable device 100 in a substantially planar configuration. In some embodiments, the planar rigid material 60 can also maintain the portable device 100 in a substantially planar configuration. In other embodiments, the securing envelope 24 can be configured to give a large degree of support and stability to the flexible support material. The securing envelope 24 can extend along one end of the flexible support material 10 and along a portion of side portions 30 of the flexible material. The securing envelope 24 can secure the flexible support material 10, can provide tension when the portable device 100 is secured, and can provide support to prevent torsional twisting of the portable device 100. The securing envelope can also be configured to allow for quick and easy attachment of the portable device 100.

Figure 3:
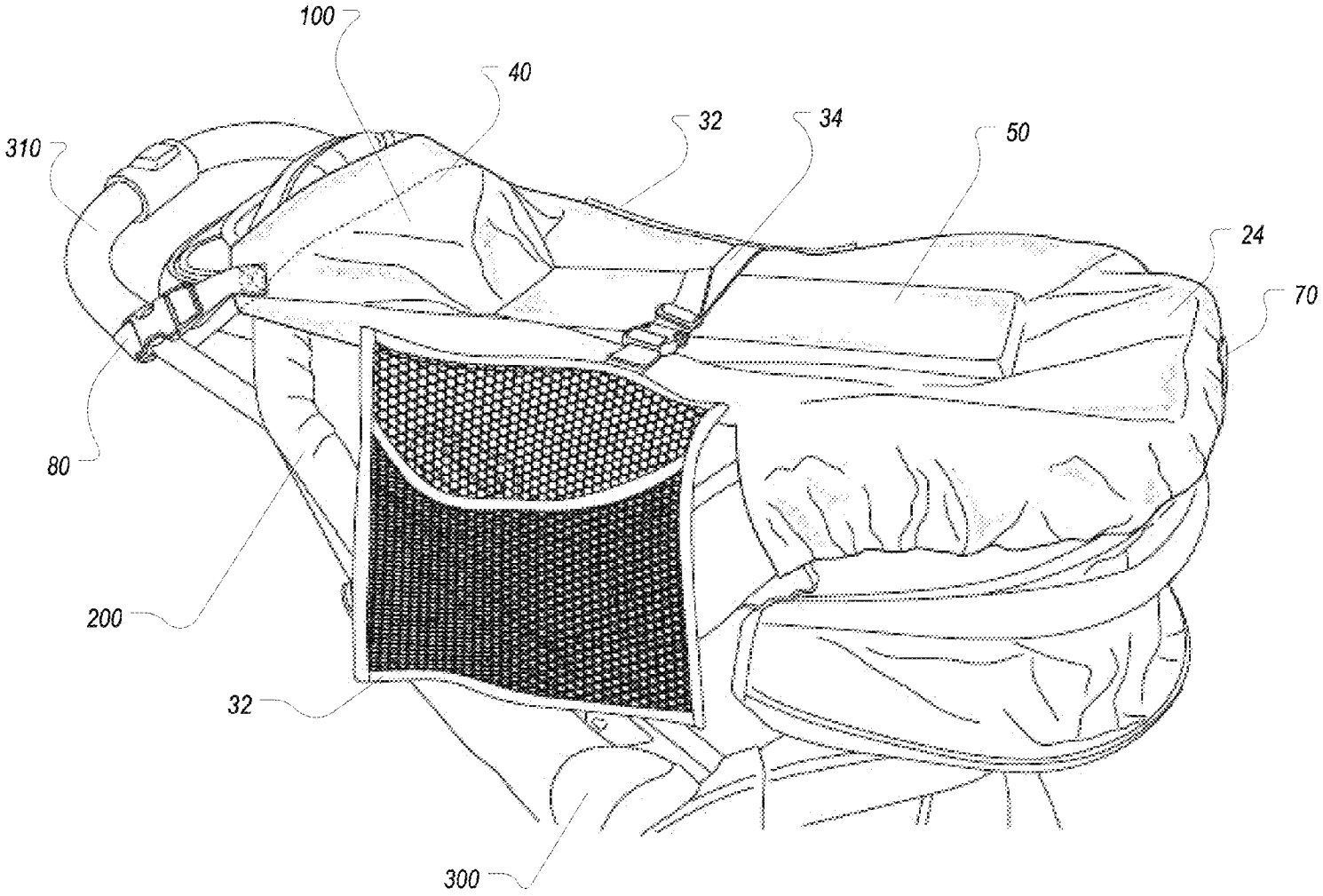
FIG. 3 illustrates a side perspective view of some embodiments of a portable device configured to convert a child safety seat or a child stroller into a diaper changing table for infants or small children.

FIG. 3 illustrates some embodiments of the portable device 100 selectably coupled to a child safety seat 200 that is attached to a child stroller 300. In other embodiments, the portable device 100 can be selectably coupled to a child safety seat 200 that is attached to a child stroller 300 by attaching the upper securing straps 80 to a handle 310 of the child stroller 300. The portable device 100 can be selectably coupled to the handle 210 of the child safety seat 200 by extending the securing envelope 24 over the handle 210 of the child safety seat 200. In some embodiments, the elastic material 22 of the securing envelope can supply tension that secures the extension 20 to the handle 210 of the child safety seat 200. In other embodiments, the lower securing strap 70 can also be secured to the handle 210 of the child safety seat 200. In yet other embodiments, the upper securing straps 80, the securing envelop 24, and/or the lower securing strap 70 can be adjusted such that sufficient tension is supplied to maintain the portable device 100 in a substantially planar configuration. In some embodiments, the planar rigid material 60 can also maintain the portable device 100 in a substantially planar configuration.

In some embodiments, upper portion 40 can be configured such that the upper portion 40 can be adjacent to the child stroller handle 310. In other embodiments, side cargo pouches 32 can be attached to the side portions 30. In yet other embodiments, the side cargo pouches 32 can comprise fabric, cloth, nylon, mesh, rip-stop fabric, or other suitable materials. In some embodiments, the side cargo pouches can be configured to hold unused diapers, diaper changing supplies, extra clothing, or any other items related to infant care or diaper changing. In other embodiments, the portable device 100 can comprise a safety strap 34. In yet other embodiments, the safety strap 34 can be configured to secure an infant 400 to the portable device 100. In some embodiments, the safety strap 34 can be configured to secure the infant 400 as the infant's diaper is being changed. In other embodiments, the safety strap 34 can be configured to secure the infant 400 as the infant's clothes are being changed. In yet other embodiments, the safety strap 34 can be attached the side portions 30 of the portable device 100. In some embodiments, the safety strap 34 can be configured to secure the infant 400 around the infant's waist. In yet other embodiments, the safety strap 34 can comprise fabric strips, rope, cord, webbing, or other suitable materials. In some embodiments, the safety strap 34 can comprise tie-down hardware, connectors, fasteners, buckles, hook and loop fasteners, or any other suitable components for securing the safety strap 34 to or around the infant 400. In other embodiments, the portable device 100 comprises a plurality of safety straps 34.

Figure 4:
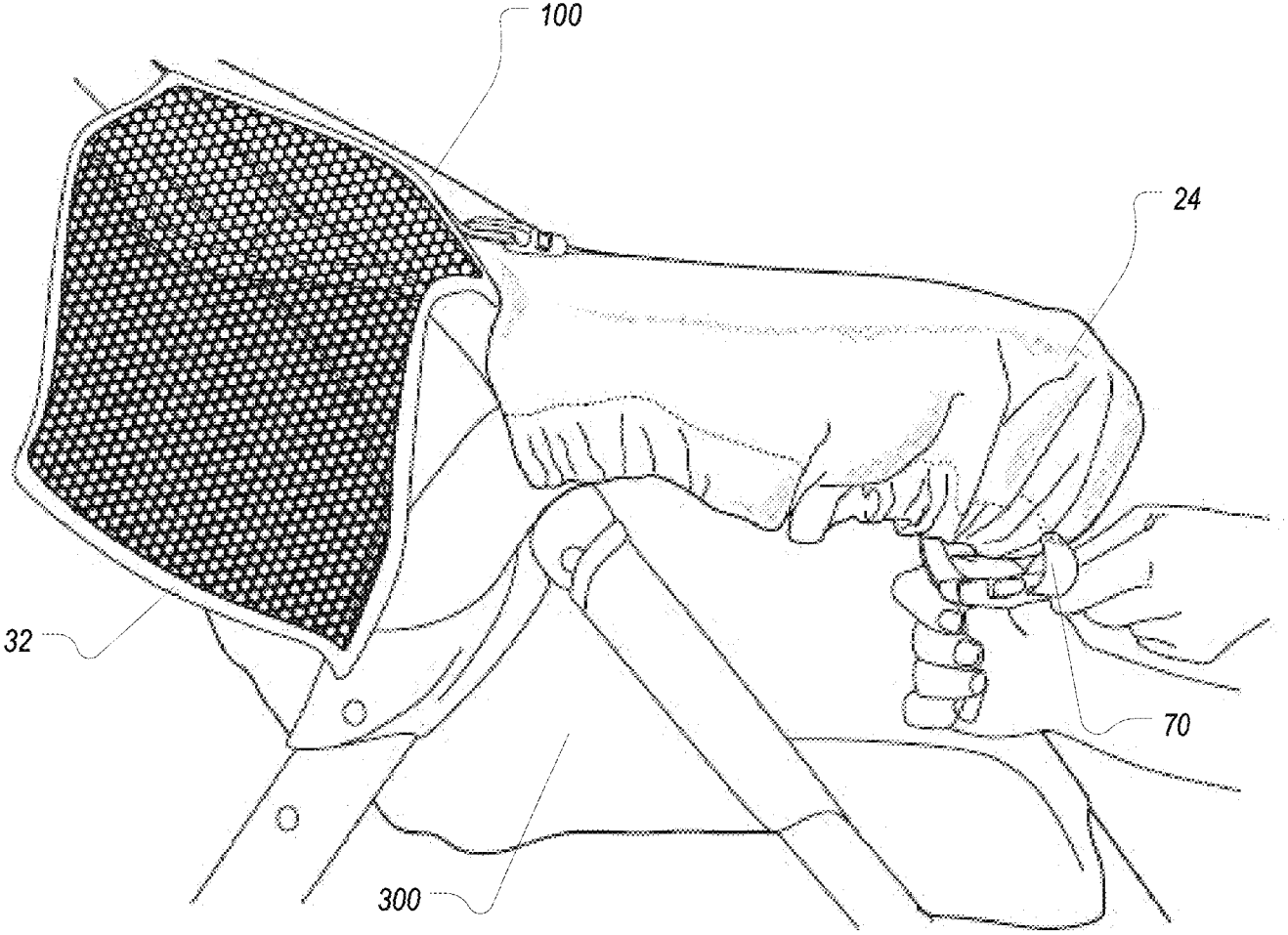
FIG. 4 illustrates some embodiments of a portable device configured to convert a child stroller into a diaper changing table for infants or small children.

FIG. 4 illustrates some embodiments of the portable device 100 selectably coupled to a child stroller 300. In other embodiments, the portable device 100 can be selectably coupled to a child stroller 300 by attaching the upper securing straps 80 to a handle 310 of the child stroller 300. The portable device 100 can be selectably coupled to a safety bar of the child stroller 300 by extending the securing envelope 24 over the safety bar of the child stroller 300. The portable device 100 can also be selectably coupled to a tray of the child stroller 300. In some embodiments, the elastic material 22 of the securing envelope can supply tension that secures the extension 20 to the safety bar of the child stroller 300. In other embodiments, the lower securing strap 70 can also be secured to the safety bar of the child stroller 300. In yet other embodiments, the upper securing straps 80, the securing envelop 24, and/or the lower securing strap 70 can be adjusted such that sufficient tension is supplied to maintain the portable device 100 in a substantially planar configuration. In some embodiments, the planar rigid material 60 can also maintain the portable device 100 in a substantially planar configuration. In other embodiments, the tension across the secured portable device 100 can provide a rigidly supported substantially horizontal surface. In yet other embodiments, a rigidly supported substantially horizontal surface can comprise any surface sufficient to change the diaper or clothes of an infant or small child. In some embodiments, a rigidly supported substantially horizontal surface can comprise any rigid or semi-rigid surface within 25 degrees of horizontal. In other embodiments, a rigidly supported substantially horizontal surface can comprise any rigid or semi-rigid surface within 40 degrees of horizontal.

In some embodiments, the portable device 100 can be selectably decoupled from the child safety seat 200. In other embodiments, the portable device 100 can be selectably decoupled from the child safety seat 200 that is attached to a stroller 300. In yet other embodiments, the portable device 100 can be selectably decoupled from the child safety seat 200 by detaching the upper securing straps 80, detaching the securing envelope 24, and/or detaching the lower securing strap 70.

Figure 5:
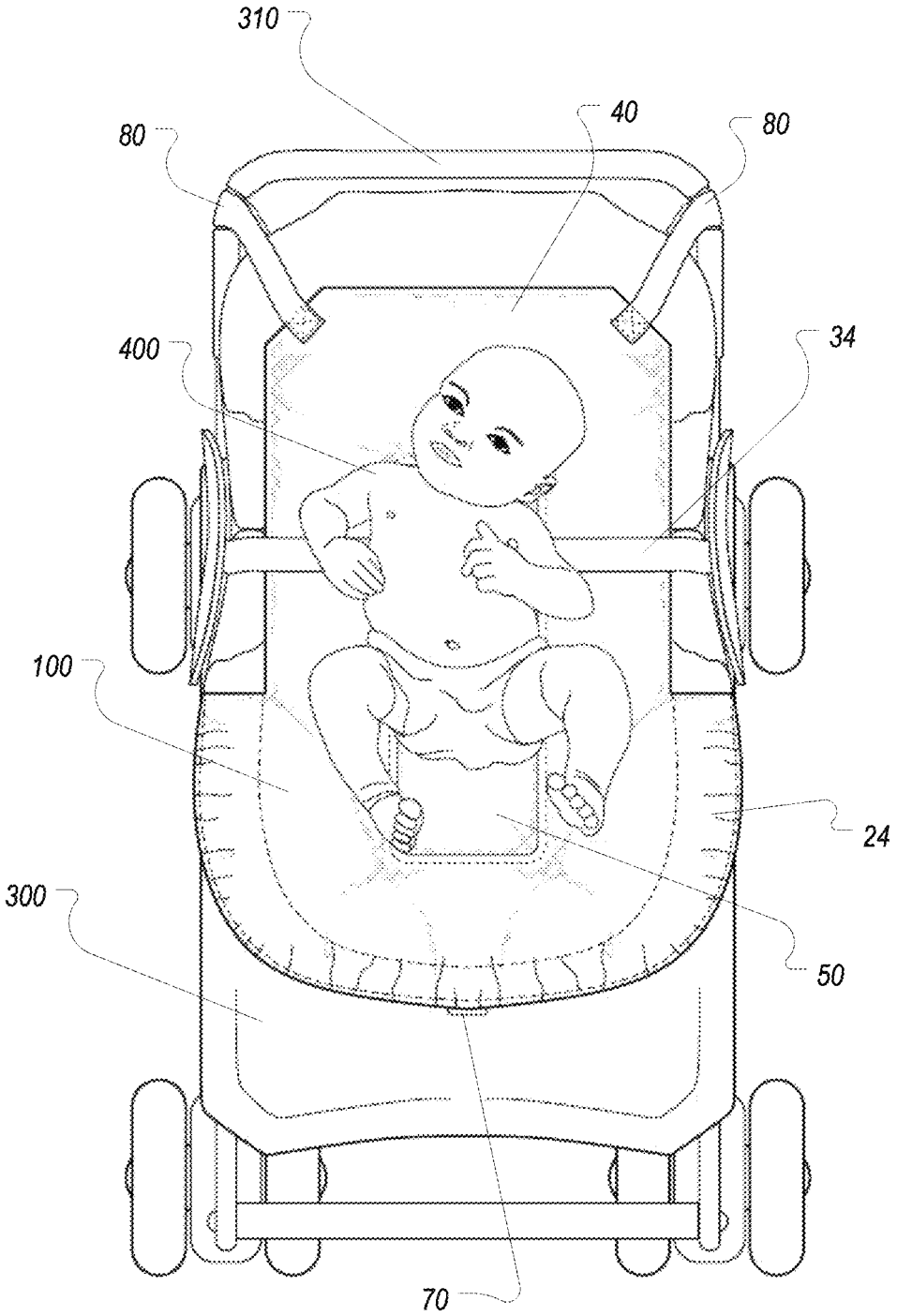
FIG. 5 illustrates a top view of some embodiments of a child placed in a portable device configured to convert a child safety seat or a child stroller into a diaper changing table for infants or small children.

FIG. 5 illustrates a top view of some embodiments of the portable device 100 selectable coupled to a child safety seat 200 that is attached to a child stroller 300. In some embodiments, the portable device 100 can be attached to the child safety seat 200 as described in FIGS. 1-4. In other embodiments, the infant 400 can be placed on the substantially planar surface generated by the tension between the portable device 100 and the securing straps 70, 80 and the securing envelope 24. The planar rigid material 60 can support the infant 400 with the tension from the securing straps 70, 80 and the securing envelope 24. In some embodiments, the infant 400 can be placed on the portable device 100 such that the infant's head rests on the upper portion 40 and the infant's legs and feet are adjacent to the extension 20. In other embodiments, the infant 400 can be secured with the safety strap 34. In yet other embodiments, a caregiver can change the infant's diaper or clothes after the infant 400 has been secured to the portable device 100.

Figure 6:
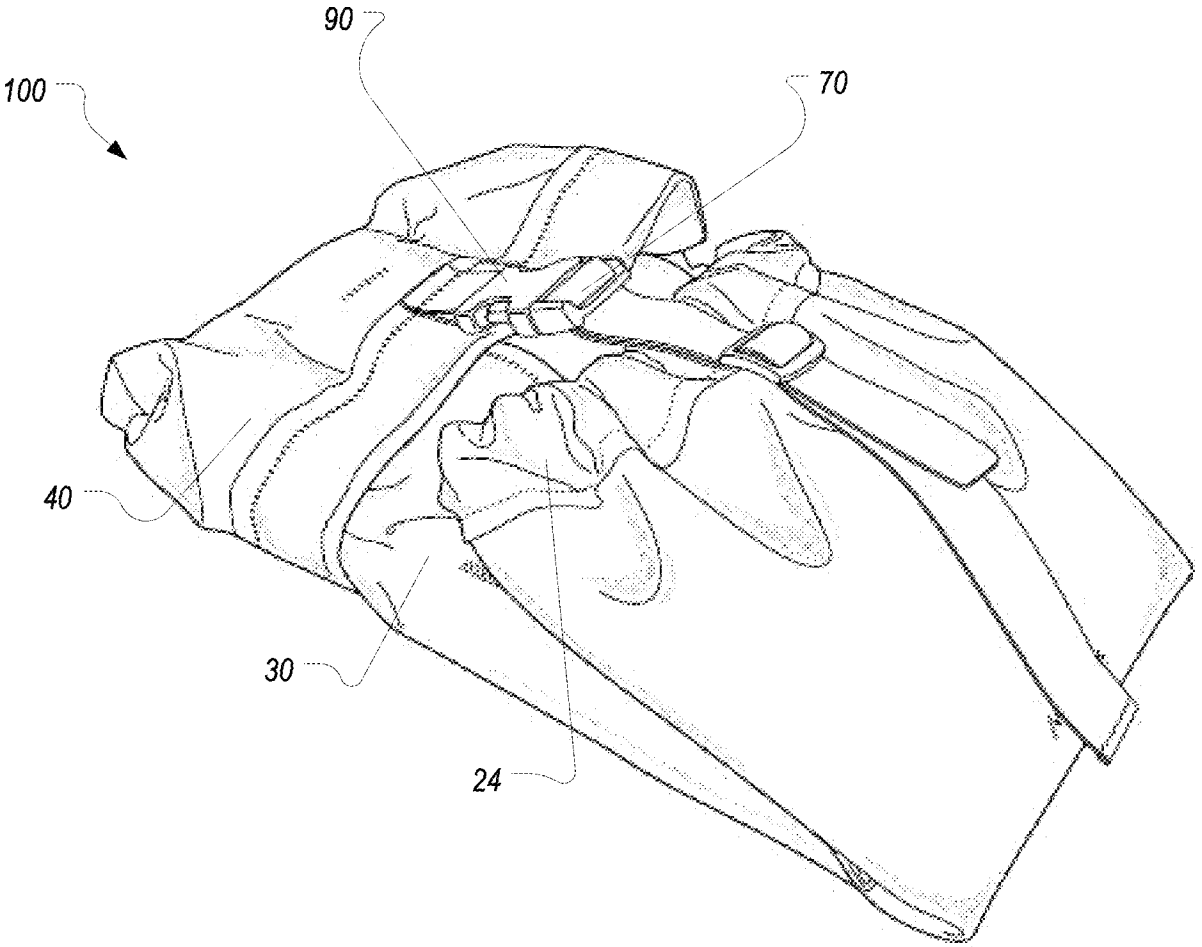
FIG. 6 illustrates a perspective view of a folded configuration of a portable device configured to convert a child safety seat or a child stroller into a diaper changing table for infants or small children.

FIG. 6 illustrates a perspective view of some embodiments of the portable device 100 in a folded or stowed configuration. In some embodiments, the portable device 100 can be folded for ease of storage or transport. In other embodiments, the portable device 100 can be rolled up for ease of storage or transport. In yet other embodiments, the portable device 100 can be folded around the planar rigid material 60. The side portions 30 can be folded into the center of the flexible material 10 by folding each side portion 30 over and onto the support pocket 50. The upper portion 40 and the extension 20 can be folded into the center of the flexible material 10 by folding each portion 20, 40 over and onto the support pocket 50. The lower securing strap 70 and the stowing buckle 90 can be selectably coupled to secure the folded configuration of the portable device 100. In some embodiments, the portable device 100 can be secured in the folded configuration by hook and loop fasteners, buttons, clips, clasps, fasteners, or any other suitable device.

Figure 7:
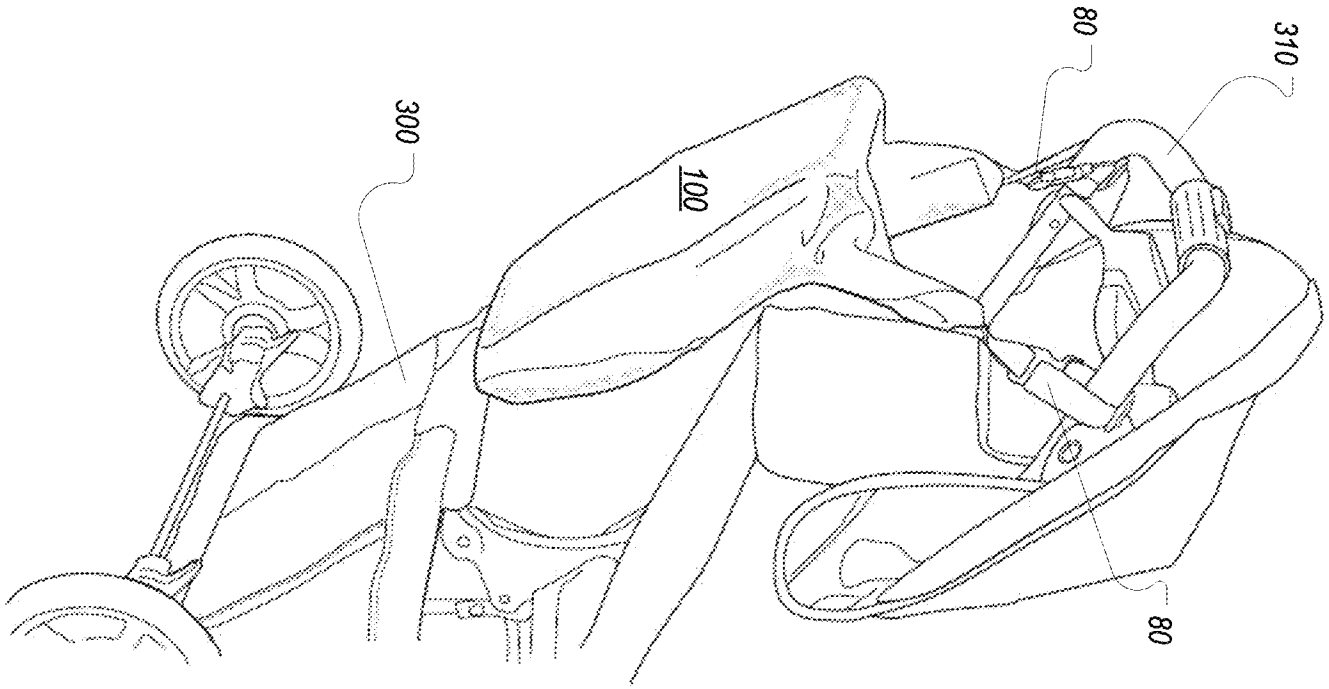
FIG. 7 illustrates some embodiments of stored folded configuration of a portable device configured to convert a child safety seat or a child stroller into a diaper changing table for infants or small children.

FIG. 7 illustrates a perspective view of some embodiments of the portable device 100 in a folded or stowed configuration. In some embodiments, the portable device 100 can be folded as described above in FIG. 6 and can then be attached to the child stroller 300. In other embodiments, the portable device 100 can be folded as described above in FIG. 6 but the upper securing straps 80 are not folded into the folded configuration. With upper securing straps 80 extending from the folded configuration, the upper securing straps 80 can be secured to the handle 310 of the child stroller 300 to store and/or transport the portable device 100. In other embodiments, the upper securing straps 80 can be used to secure the portable device 100 to other object for storage. In yet other embodiments, the upper securing straps 80 can be joined to form a carrying strap for the portable device 100. In some embodiments, the portable device 100 in the folded configuration can be attached by the upper securing straps 80 to the handle 310 of the child stroller 300 for storage and when needed the portable device 100 can be unfolded, fully secured, and used to change the infant's diaper or clothes.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

It is contemplated that numerical values, as well as other values that are recited herein are modified by the term "about", whether expressly stated or inherently derived by the discussion of the present disclosure. As used herein, the term "about" defines the numerical boundaries of the modified values so as to include, but not be limited to, tolerances and values up to, and including the numerical value so modified. That is, numerical values can include the actual value that is expressly stated, as well as other values that are, or can be, the decimal, fractional, or other multiple of the actual value indicated, and/or described in the disclosure.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

I claim:

1. A portable changing table comprising:

a flexible support material configured to support an infant or a small child;

two side portions each extending from opposite sides of the flexible support material;

an upper portion extending from an upper end of the flexible support material;

an lower extension that extends from a lower portion of the flexible support material, comprising:

(1) an outer perimeter of the lower extension that is rounded in shape;

(2) a width that is greater than the width of the two side portions; and (3) a securing envelope that extends along a lower end of the flexible support material and along a portion of the two side portions of the flexible support material, the securing envelope comprising: one of a drawstring, elastic cord, elastic material, and adjustable strap and buckle, embedded into an outer perimeter of the lower extension, the securing envelope structured to form a planar surface of the securing envelope when the portable changing table is attached to a child safety seat, a safety bar of a child stroller, or a tray of the child stroller, allowing for easy initial attachment of the portable changing table to the child safety seat or the child stroller, and preventing torsional twisting of the portable changing table relative to the child safety seat or the child stroller;

a support pocket disposed at the center of and within the flexible support material;

a rigid planar material disposed within the support pocket, the rigid planar material configured to rigidly support the flexible support material to support the infant or the small child;

a stowing buckle attached to back of the support pocket, and structured to secure the portable changing table in folded configuration;

a lower securing strap comprising an adjustments means and a buckle, wherein the lower securing strap is attached to the lower extension that extends from the lower portion of the flexible support material, and configured to secure the portable changing table to the child safety seat or the child stroller, while the portable changing table is supporting the infant or the small child, and configured to selectively couple with the stowing buckle to securely hold the changing table in a folded configuration;

at least two upper securing straps attached to the upper portion, the at least two upper securing straps structured to secure the portable changing table to the handle of the child safety seat, or the handle of a child stroller, while the portable changing table is supporting the infant or the small child, and are structured to extend from the portable changing table while in a folded configuration allowing the portable changing table to remain secured to the child safety seat, the child stroller, or joined together to form a carrying strap while the portable changing table is in a folded configuration to facilitate transport of the foldable changing table;

a safety strap structured to secure the infant or the small child to the portable changing table, wherein the safety strap is attached to the side portions of the portable changing table;

wherein, each of the upper securing straps, the securing envelope, and the lower securing strap can be adjusted to tension the portable changing table into a substantially horizontal and planar surface once attached to the child safety seat or the child stroller and tensioned, the lower securing strap, the at least two upper securing straps, and securing envelope provide a tension across the flexible support material thereby providing a rigidly supported substantially horizontal and planar surface where a caregiver can change a diaper or clothes of the infant or small child.

2. The portable changing table of claim 1, wherein the at least two upper securing straps attach to an end opposite the securing envelope, the lower securing strap attached to the lower extension.

3. The portable changing table of claim 2, wherein the upper securing straps are configured to secure the flexible support material the child safety seat or the stroller selected from the group consisting of: a stroller handle, and a lower portion of the child safety seat.

4. The portable changing table of claim 3, wherein the securing envelope is configured to secure the flexible support material to the child safety seat or the stroller selected from the group consisting of: a handle of the child safety seat, to a safety bar, and a tray of the child stroller.

5. The portable changing table of claim 4, wherein the lower securing strap is configured to secure the flexible support material to the child safety seat or the stroller selected from the group consisting of: the handle of the child safety seat, to the safety bar, and the tray of the child stroller.

6. The portable changing table of claim 5, wherein the portable changing table is configured to be secured to an object selected from the group consisting of: a child safety seat, a child safety seat attached to a child stroller, and to a child stroller.

7. The portable changing table of claim 1, wherein the flexible support material comprises cloth fabric, synthetic fabric, canvas, nylon, rip-stop fabric or combinations thereof.

8. The portable changing table of claim 1, wherein the rigid planar material comprises wooden shelving board, high density foam, water resistant foam, plastic, high density fabric, metal sheeting, firm padding or combinations thereof.

9. The portable changing table of claim 1, wherein the securing envelope comprises an elastic material.

10. The portable changing table of claim 1, further comprising one or more side cargo pouches attached to a side portion of the flexible support material.

11. A portable changing table comprising:

a flexible support material configured to support an infant or a small child;

a support pocket disposed within the flexible support material;

a rigid planar material disposed within the support pocket, the rigid planar material configured to rigidly support the flexible support material to support the infant or the small child;

a securing envelope attached to an end of the flexible support material, the securing envelope configured to selectably attach to a handle of a child safety seat or a tray or a safety bar of a child stroller;

upper securing straps attached to the flexible support material and configured to selectably attach the flexible support material to a lower portion of the child safety seat or a handle of the child stroller;

a lower securing strap configured to selectably attach to the handle of the child safety seat or the tray or the safety bar of the child stroller; and a stow buckle configured to detachably connect with the lower securing strap to secure the portable changing table in a folded configuration;

wherein, once attached to the child safety seat or the child stroller, the securing straps and securing envelope provide a tension across the flexible support material thereby providing a rigidly supported substantially horizontal surface where a caregiver can change a diaper or clothes of the infant or small child.

12. The portable changing table of claim 11, wherein the securing envelope comprises an elastic material.

13. The portable changing table of claim 11, further comprising one or more side cargo pouches attached to a side portion of the flexible support material.

14. The portable changing table of claim 11, further comprising a safety strap configured to secure the infant or small child to the portable changing table.

15. A method of providing a portable changing table comprising:

providing a flexible support material configured to support an infant or a small child, the flexible support material comprising:

a support pocket disposed within the flexible support material;

a rigid planar material disposed within the support pocket, the rigid planar material configured to rigidly support the flexible support material to support the infant or the small child;

an extension extending from the flexible support material and forming a securing envelope, the securing envelope configured to selectably attach to a child safety seat or a child stroller; and straps attached to the flexible support material and configured to attach the flexible support material to the child safety seat or the child stroller;

attaching the securing envelope to the child safety seat or the child stroller; and attaching the straps to the child safety seat or the child stroller;

wherein, once attached to the child safety seat or the child stroller, the straps and securing envelope provide a tension across the flexible support material thereby providing a rigidly supported substantially horizontal surface where a caregiver can change a diaper or clothes of the infant or small child.

16. The method of claim 15, wherein the securing envelope comprises an elastic material.

17. The method of claim 15, wherein the flexible support material further comprises a safety strap configured to secure the infant or small child to the portable changing table.

* * * * *